US007575486B2

(12) United States Patent
Weber et al.

(10) Patent No.: US 7,575,486 B2
(45) Date of Patent: Aug. 18, 2009

(54) SCREW CONNECTING TERMINAL AND METHOD FOR ITS PRODUCTION

(75) Inventors: Ralf Weber, Heidelberg (DE); Gerhard Ziegler, Lobbach-2 (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 12/219,581

(22) Filed: Jul. 24, 2008

(65) Prior Publication Data

US 2009/0029604 A1 Jan. 29, 2009

(30) Foreign Application Priority Data

Jul. 26, 2007 (DE) ..... 10 2007 035 016

(51) Int. Cl.
*H01R 4/36* (2006.01)

(52) U.S. Cl. ..... 439/811

(58) Field of Classification Search ..... 439/791, 439/801, 803, 810, 811, 812, 814, 885
See application file for complete search history.

(56) References Cited

U.S. PATENT DOCUMENTS

| | | | | |
|---|---|---|---|---|
| 2,159,757 | A * | 5/1939 | Blakeslee | 439/811 |
| 2,953,771 | A | 9/1960 | Kussy | |
| 5,553,787 | A * | 9/1996 | Guginsky | 439/472 |
| 5,674,079 | A * | 10/1997 | Auclair | 439/92 |
| 7,252,534 | B2 * | 8/2007 | Reibke | 439/404 |
| 2005/0029003 | A1 | 2/2005 | Conrad | |

FOREIGN PATENT DOCUMENTS

| | | |
|---|---|---|
| DE | 40 13 225 B4 | 10/1991 |
| DE | 696 02 758 T | 3/2000 |
| DE | 101 55 924 A1 | 7/2002 |
| DE | 698 07 799 T | 5/2003 |
| DE | 103 15 668 | 3/2004 |
| EP | 1 596 471 | 11/2005 |

OTHER PUBLICATIONS

German Search Report Application No. 10 2007 035 016.5, dated May 19, 2008.

* cited by examiner

*Primary Examiner*—Tho D Ta
(74) *Attorney, Agent, or Firm*—Buchanan Ingersoll & Rooney PC

(57) ABSTRACT

The disclosure relates to a screw connecting terminal which comprises a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw.

15 Claims, 5 Drawing Sheets

SCREW CONNECTING TERMINAL AND METHOD FOR ITS PRODUCTION

RELATED APPLICATION

This application claims priority under 35 U.S.C. §119 to German Patent Application No. 10 2007 035 016.5 filed in Germany on Jul. 26, 2007, the entire content of which is hereby incorporated by reference in its entirety.

TECHNICAL FIELD

The disclosure relates to a screw connecting terminal, to a service switching device having a screw connecting terminal, and to a method for production of a screw connecting terminal.

BACKGROUND INFORMATION

A screw connecting terminal of this generic type has a clamping part, which is essentially in the form of a frame with longitudinal, narrow and broad faces, a clamping screw which is held in a threaded opening in the clamping part, and a busbar which passes through the interior of the frame-like clamping part and is arranged such that it can move with respect to the clamping part, and whose broad face in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw.

Screw connecting terminals of this generic type are also known as strain-relief clamps. DE 40 13 225 B4 and DE 101 55 924 A1 disclose examples of embodiments of generic strain-relief clamps. These are normally used in service switching devices, for example in circuit breakers or residual current devices, in order to connect connecting conductors, to the service switching device, irrespective of whether these connecting conductors are stripped cable ends of flexible wiring cables or fixed contact lugs of busbar arrangements. As is known, service switching devices are used to monitor and to connect and disconnect the current flow on a current path which passes through the interior of the appliance from a connecting terminal on the input side to one on the output side. For this purpose, the screw connecting terminals are fitted in the interior of the service switching device housing, in a terminal accommodation area which is generally accommodated close to the narrow face of a service switching device such as this.

The busbar is generally mounted in a fixed position in the interior of the housing. Internal connecting conductors are fitted to its free end facing the interior of the appliance and continue the current path between the connecting terminals on the input and output sides, with the current path also being passed by further functional assemblies or components in the housing interior, for example via a contact point, and possibly via a thermal or magnetic release.

Since the busbar is mounted in a fixed position, the clamping part moves relative to the busbar during operation of the clamping screw. During production of a service switching device, it is often necessary to carry out so-called thermal adjustment of the thermal release at the end of the manufacturing process. For this purpose, test probes in a test apparatus make contact with a specific contract pressure with the busbars of the connecting terminals on the input and output sides, during which process it is possible for the busbar to be pushed from its fixed position into the interior of the housing by the contact pressure of the test probe, thus rendering the appliance no longer useable.

SUMMARY

A screw connecting terminal is disclosed and a service switching device is disclosed having a screw connecting terminal such as this such that movement of the connecting terminal into the interior of the appliance housing as a result of external contact pressure is avoided.

A method for production of a screw connecting terminal is disclosed, using which method this screw connecting terminal can be produced at high speed on an automatic manufacturing and assembly machine.

A screw connecting terminal is disclosed which comprises a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw, wherein the busbar is fitted at its free end with an approximately rectangular contact plate whose length is greater than the width of the interior of the clamping part which holds the busbar, such that the free ends of the contact plate project beyond the frame-like clamping part on both sides when the busbar is in the installed state, with its length being less than the height of the interior of the clamping part which holds the busbar.

A service switching device is disclosed, e.g., a circuit breaker or residual current device, having an insulating material housing which has at least one front face and one attachment face as well as narrow and broad faces which connect the front and attachment faces, and which service switching device has, in the area of the narrow faces, a terminal accommodation area for a connecting terminal for the connection of an electrical connecting conductor, having a screw connecting terminal, wherein holding means for mounting the free ends of the contact plate in a fixed position are provided close to the narrow face of the housing in the interior of the housing.

In another aspect, a method is disclosed for production of a screw connecting terminal having a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw. The method comprising the following steps: stamping out the busbars from the stamping area of an elongated sheet-metal strip, while retaining a connection between the busbar narrow faces and a transport area of the sheet-metal strip; bending a free end of the stamped-out busbars in order to form contact plates; pushing the clamping part, which is rotated through 90° with respect to an installed position in a narrow-face plane, over the free end of the busbars, such that the contact plate projects beyond the clamping part; rotation of the clamping part back through 90° such that it comes to rest in its installed position with respect to the busbar, and the free ends of the contact plate, which project beyond the clamping part, prevent the clamping part from sliding off the busbar; and separation of the busbar with the clamping part fitted to it from the transport area of the sheet-metal strip, and thus separation of the completely assembled screw connecting terminals.

BRIEF DESCRIPTION OF THE DRAWINGS

The disclosure as well as further advantageous refinements and improvements of the disclosure will be explained and described in more detail with reference to the drawings, which illustrate one exemplary embodiment of the disclosure, and in which.

DETAILED DESCRIPTION

Figure 1:
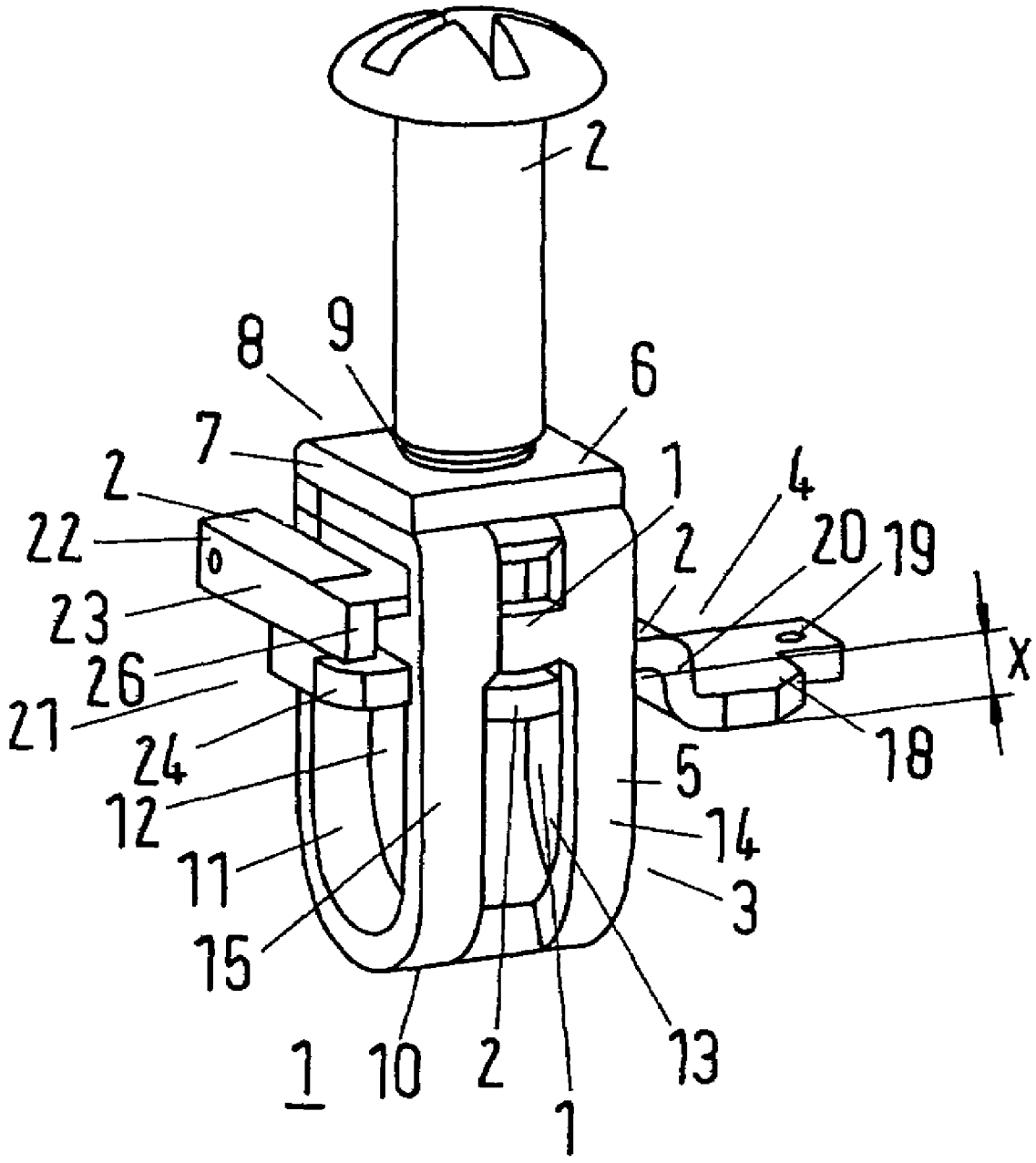
FIG. 1 shows an exemplary screw connecting terminal according to the disclosure.

Thus, according to the disclosure, the busbar is fitted at its free end with an approximately rectangular contact plate whose length is greater than the width of the interior of the clamping part which holds the busbar, such that the free ends of the contact plate project beyond the frame-like clamping part on both sides when the busbar is in the installed state, with its length being less than the length of the interior of the clamping part which holds the busbar.

With the screw connecting terminal according to the disclosure, the free ends of the busbar which project at the side beyond the clamping part can be used as opposing bearings, by means of which the busbar can be supported close to the conductor insertion opening of the screw connecting terminal, in addition to opposing bearings in the interior of the housing, thus making it possible to prevent the screw connecting terminal from being pushed in by a test probe being pushed onto it from the outside. The disclosed ratio between the length of the contact plate and the length of the interior of the clamping part which holds the busbar can allow the screw connecting terminal according to the disclosure to be assembled easily, quickly and automatically.

According to one exemplary refinement of the disclosure, the threaded opening which holds the clamping screw is fitted in a broad face of the frame-like clamping part. In this case the clamping part may be a stamped and bent part with a particularly reinforced upper broad face, in which the thread is incorporated. The interior of the clamping part which holds the busbar then extends in the longitudinal extent direction of the frame-like clamping part between its upper and its lower broad face. In this case, the lower broad face may also be rounded or curved.

According to a further exemplary embodiment of the disclosure, the broad face of the contact plate is aligned approximately at right angles to the broad face of the busbar. Since the broad face of the busbar is oriented approximately parallel to the broad face of the clamping part and at right angles to the longitudinal face of the clamping part, where the holding opening for the connecting conductor is arranged, the broad face of the contact plate therefore runs parallel to this longitudinal face of the clamping part, where the holding opening for the connecting conductor is incorporated. The test probe can then make contact during the thermal adjustment process from the same direction from which a connecting conductor would also be inserted into the screw connecting terminal during normal use of the service switching device.

The contact plate can be integrally connected to the busbar. The busbar can be in the form of a stamped and bent part, and the contact plate is formed by bending an end piece of the busbar after the busbar has been stamped out.

An exemplary service switching device has an insulating material housing which has at least one front face and one attachment face as well as narrow and broad faces which connect the front and attachment faces, and which service switching device has, in the area of the narrow faces, a terminal accommodation area for a connecting terminal for the connection of an electrical connecting conductor, having a screw connecting terminal according to the disclosure, in which holding means for mounting the free ends of the contact plate in a fixed position are provided close to the narrow face of the housing in the interior of the housing.

In one exemplary refinement, the holding means may in this case be in the form of plug pockets which are fitted to the inner housing broad face close to the narrow face of the housing and whose internal dimensions correspond to the external dimensions of the free ends of the contact plate. In the case of service switching devices with a slimline insulating material housing, that is to say in which two housing half-shells are placed one on top of the other and are connected to one another along a joining line, a first plug pocket can be incorporated in the first housing half-shell, and the second plug pocket can be incorporated in the second housing half-shell. A first side part of the screw connecting terminal is then inserted into the first plug pocket first, during the assembly process, after which the second housing half-shell is fitted to the first housing half-shell, with the second side part then being introduced into the second plug pocket at the same time. When the two housing halves are then connected to one another, the screw connecting terminal is then held virtually captive by the free ends of the busbar in the plug pockets.

A method according to the disclosure for production of a screw connecting terminal according to the disclosure is characterized by the following method steps:

- stamping out the busbars from the stamping area of an elongated sheet-metal strip, while retaining a connection between the busbar narrow faces and the transport area of the sheet-metal strip,
- bending the free end of the stamped-out busbars in order to form the contact plates,
- pushing the prefabricated clamping part, which is rotated through 90° with respect to the installed position on the narrow-face plane, over the free end of the busbars, such that the contact plate projects beyond the clamping part,
- rotation of the clamping part back through 90° such that it comes to rest in its installed position with respect to the busbar, and the free ends of the contact plate, which project beyond the clamping part, prevent the clamping part from sliding off the busbar, and separation of the busbar with the clamping part fitted to it from the transport area of the sheet-metal strip, and thus separation of the completely assembled screw connecting terminals.

In the production method according to the disclosure, the steps of "stamping the busbar", "bending the busbars"and "fitting the clamping parts to the busbar" are carried out successively on parts which are connected to one another via the transport strip, with the transport strip being produced automatically during stamping of the busbars and not having to be separately attached, and with the busbars being aligned and positioned automatically for fitting of the clamping part so that the method can thus be carried out at high speed, in a manner which can be automated. A correspondingly configured automatic manufacturing machine is supplied as material just with an endless sheet-metal strip and the prefabricated, frame-like clamping parts. The busbars are stamped out of the sheet-metal strip, with a side strip remaining as a transport strip, by means of which the stamped-out busbars are transported to the other processing stations. The free end of the busbar is then bent at the next station within the automatic machine so that this results in the contact plate being formed in the predetermined position on the busbar. The busbars are then passed on with the contact plates on the transport strip to the station in which the clamping parts are pushed onto the busbars.

The ratio that has been matched according to the disclosure of the length of the interior of the frame-like clamping part, the length of the contact plate and the width of the longitudinal face of the clamping part in which the insertion opening for the connecting conductor is incorporated is now important for this purpose. This is because this means that it is possible for the clamping part to be pushed over the contact plate and onto the busbar, rotated through 90° such that the longitudinal extent direction of the longitudinal face of the frame-like clamping part runs parallel to the longitudinal extent direction of the contact plate. The frame-like clamping part is now rotated through 90° to a position such that the contact plate is at right angles to the longitudinal extent direction of the longitudinal face of the clamping part and, in this position, the side parts of the busbar project beyond the frame-like clamping part on the sides, so that the clamping part can no longer slide down from the busbar at the free end of the busbar. The other end of the busbar is in fact still attached to the transport strip, so that the clamping part overall is connected in a captive manner to the busbar in this manufacturing step, itself. Up to this point, the handling is considerably simpler (because of the fixing on the transport strip which at the same time is the material supply for stamping of the busbar) than if busbars which have been separated from the start were to be supplied in the previously known conventional manner. This is because they would then first of all have to be sorted and aligned in the automatic machine and held for fitting of the clamping part, thus making the handling process complicated.

The clamping screw has already been inserted into the clamping part before the latter is pushed onto the busbar. The clamping screw can thus be tightened until the clamping part is fixed on the busbar, before the screw connecting terminals are separated from the sheet-metal strip.

Once the screw connecting terminals have now, as a final process step, been cut off the transport strip, and thus separated, they are completely installed. All that may still be required is reworking of the cut edge, for example deburring.

FIG. 1 therefore shows a screw connecting terminal 1, such as that which can be inserted into service switching devices and has a clamping screw 2, a clamping part 3 which is essentially in the form of a frame, and a busbar 4.

The clamping part 3 is formed by a slotted conductor strip 5 which is bent to form an approximately rectangular or box-shaped frame. The two free ends 6, 7 of the slotted conductor strip 5 are bent at right angles towards one another so that they form overlapping frame limbs which represent the upper broad face 8 of the clamping part 3. There is an opening 9 with an internal thread for holding the clamping screw 2 in the upper broad face 8.

The lower broad face 10 of the clamping part 3, opposite the upper broad face 8, is in this case rounded. However, it could also be flat, although this would involve an additional processing step during the production of the clamping part 3.

The clamping part 3 is in the form of an open frame, thus forming an insertion opening 12 on the longitudinal face 11 for the connecting conductor that is to be connected.

The narrow face 13 of the clamping part 3 is essentially formed by two webs 14, 15, which run parallel to one another in the longitudinal direction and have a cut-out 16 between them, because of the slotting of the conductor strip 5 which forms the clamping part 3, with the webs 14, 15 being held together by lateral clasps 17.

The busbar 3 is essentially in the form of a rectangular, flat conductor piece. It is guided such that it can move in the interior of the clamping part 3, between the upper and the lower broad face 8, 10, in the longitudinal extent direction of the clamping part 3. At its free end 18 facing away from the insertion opening 12, the busbar is configured for connection of a further connecting conductor, which leads into the interior of the service switching device. For this purpose, it has a rectangular recess and a hole 19 there. Furthermore, the busbar is provided with a stepped bend on a bending edge 20 there, so that the free end 18 is moved parallel downwards through a distance x with respect to the rest of the busbar.

Figure 3:
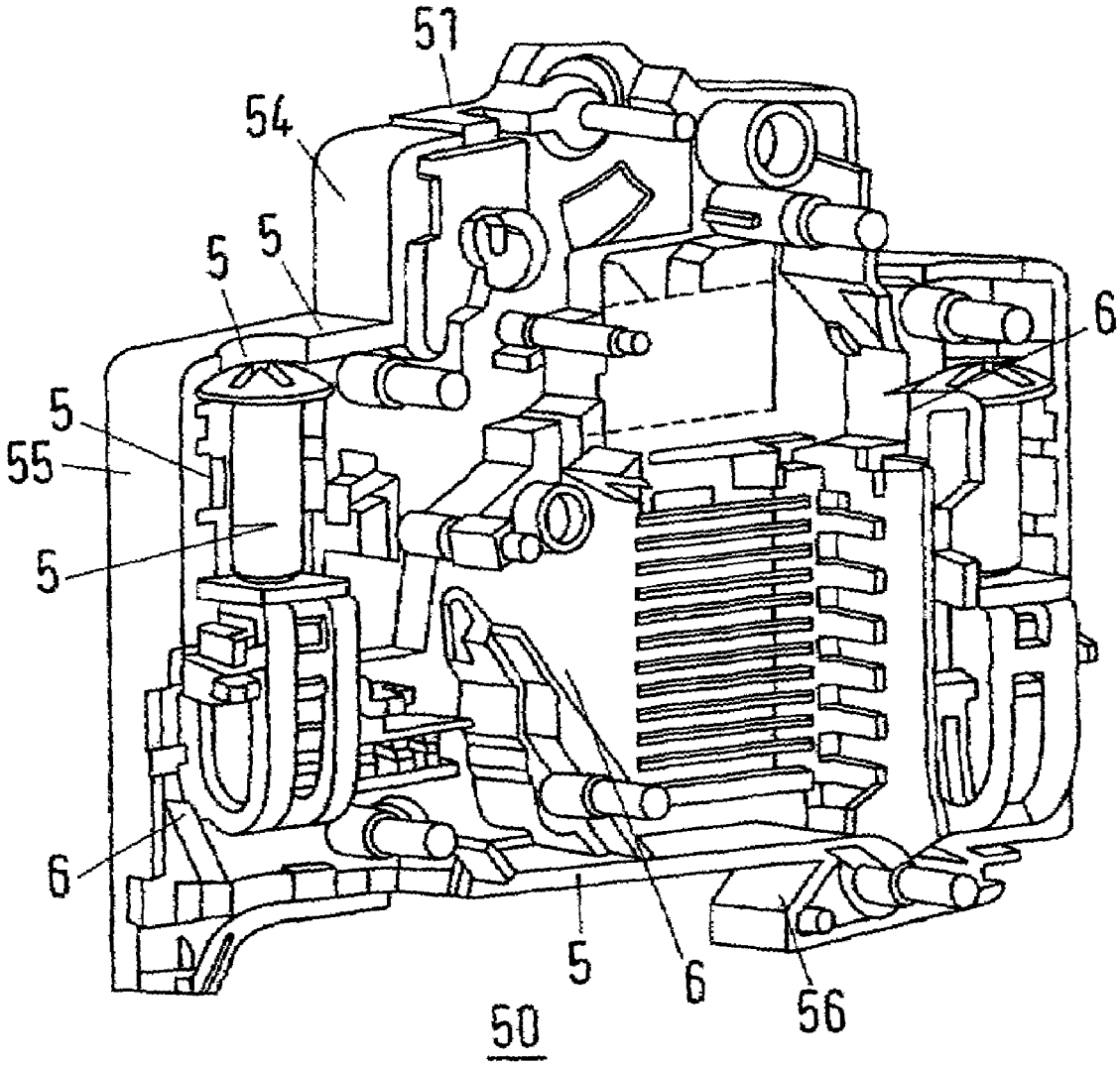
FIG. 3 shows a view into an open housing half-shell of a service switching device according to the disclosure having a screw connecting terminal according to the disclosure.
Figure 4:
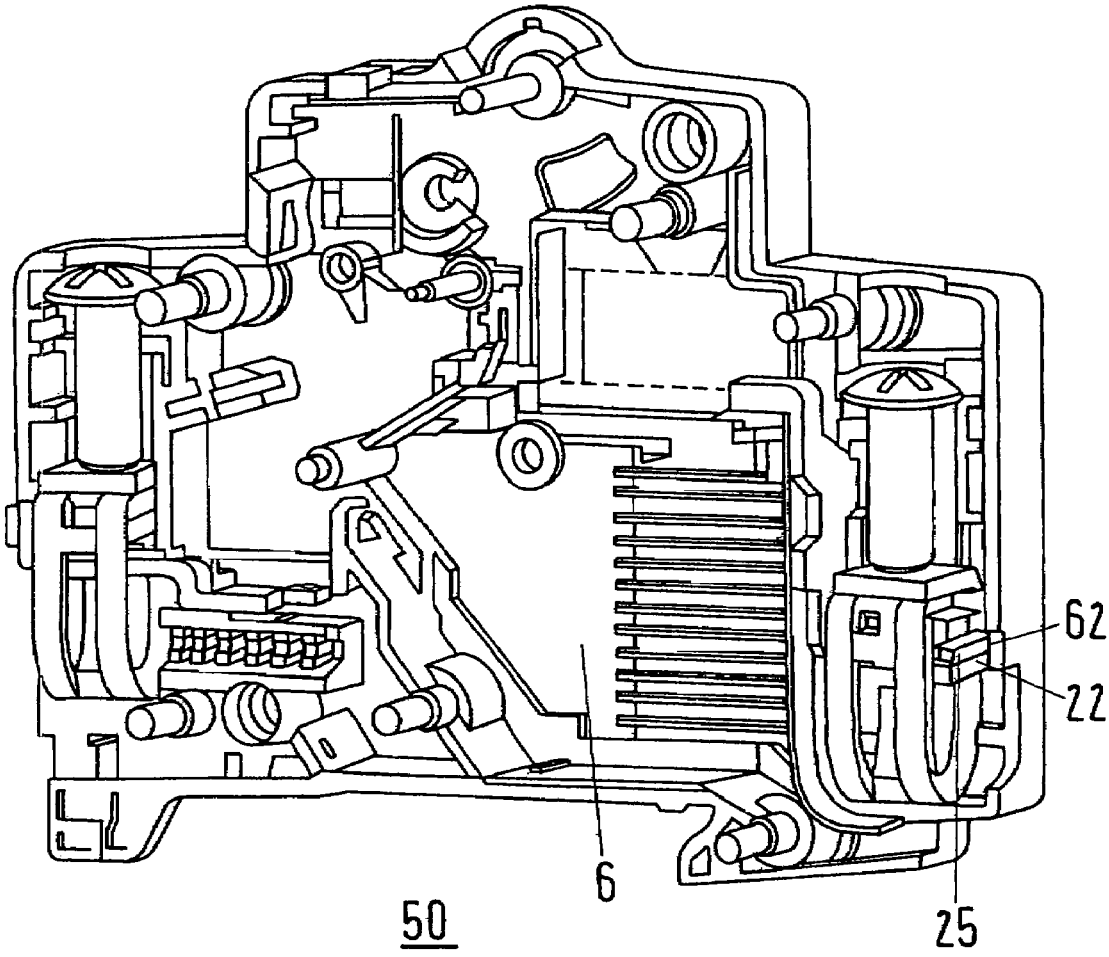
FIG. 4 shows a second view into an open housing half-shell of a service switching device according to the disclosure, with a screw connecting terminal according to the disclosure.

The free end 21 of the busbar 3 facing the insertion opening 12 is bent upwards through about 90° at a bending edge 24, so that it forms a contact plate 22. The contact plate 22 is rectangular and its broad face 23 runs parallel to the longitudinal face 11 of the clamping part 3, running in front of the longitudinal face 11 of the clamping part 3 in the insertion direction of a connecting conductor. In this case, the free ends 26, 27 of the contact plate 22 project at the sides beyond the clamping part 3, so that the ends which project beyond the clamping part 3 of the free ends 26, 27 form holding tongues, so to speak, by means of which the contact plate can be held in an appropriately corresponding holder in the housing of the service switching device, as shown in FIGS. 3 and 4.

Guide tongues 25 are also integrally formed on the longitudinal face of the busbar 3, by means of which the busbar 3 is guided in the cut-out 16 between the two webs 14, 15, which run parallel, on the narrow face 13 of the clamping part 3. The busbar can therefore move between the lateral clasp 17 and the lower broad face 10 in the interior of the frame-like clamping part, parallel to its longitudinal extent direction.

When the clamping screw 2 is tightened and is screwed into the interior of the clamping part 3, then its free end presses on the broad face 29 of the busbar 4 facing the clamping screw 2. The clamping part 3 is therefore moved upwards relative to the busbar 4, so that the lower broad face 10 is moved towards the busbar 4 and a connecting conductor can be clamped between the busbar 4 and the lower broad face 10.

Figure 2:
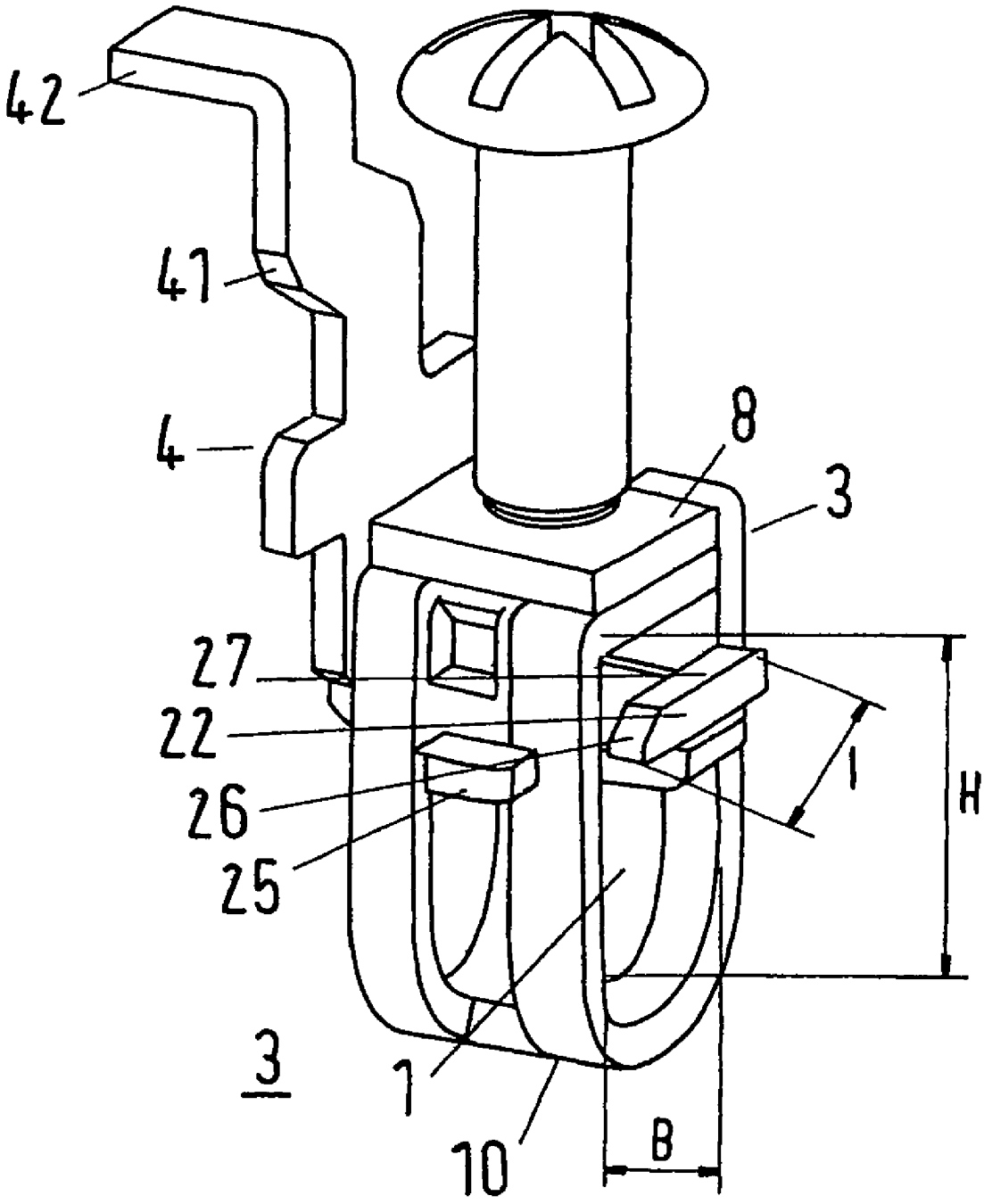
FIG. 2 shows a second exemplary embodiment of a screw connecting terminal according to the disclosure.

FIG. 2 shows a second exemplary embodiment of a screw connecting terminal 30 according to the disclosure, which differs from that shown in FIG. 1 by the shape of that part of the busbar 4 which projects into the interior of the housing.

Identical parts or parts having the same effect are provided with the same reference symbols in FIG. 2 as in FIG. 1.

On its side facing the inside of the appliance, the busbar is first of all bent upwards through about 90° to form a vertical limb 41, at whose end it is then once again bent through 90° to form a horizontal end piece. The position of assemblies located in the housing interior is matched to the position of the screw connecting terminal 30 by means of the vertical limb 41.

One important feature in the context of the disclosure is that the length l of the contact plate 22 is less than the height H of the interior of the clamping part 3, which holds the busbar 4, on the longitudinal face 11 between the upper and the lower broad faces 8, 10. This feature allows the screw connecting terminal according to the disclosure to be manufactured very quickly and in an automated manner, as will now be explained with reference to FIG. 5.

Figure 5:
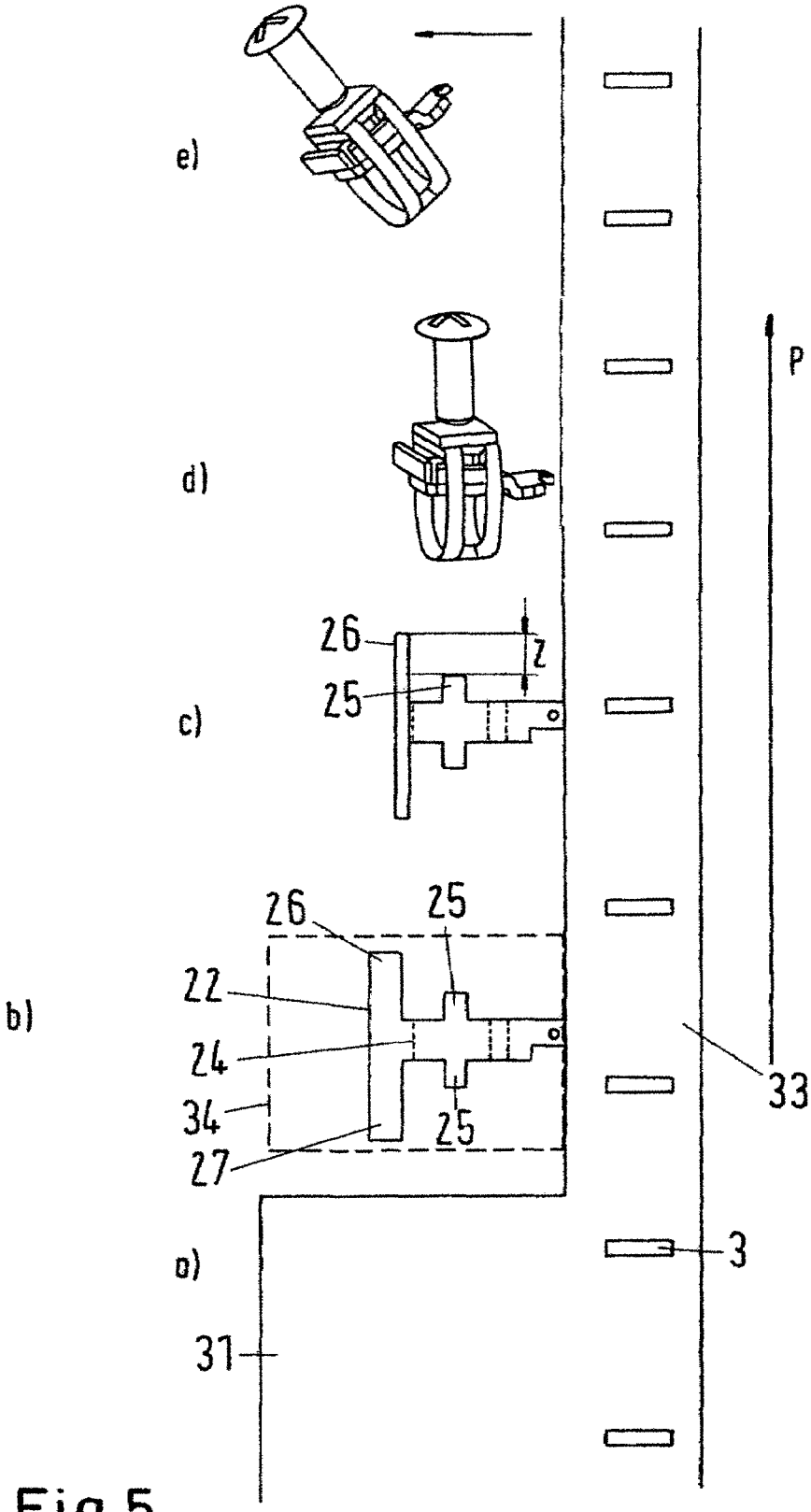
FIG. 5 shows a schematic view of a transport strip when the production method according to the disclosure is used for the screw connecting terminals according to the disclosure.

FIG. 5 schematically illustrates the manufacturing steps for a production method according to the disclosure for a screw connecting terminal in the form of step elements a) to f). By way of example, these method steps can be carried out in a high-speed automatic manufacturing machine, which is not illustrated here.

On its right-hand edge, a sheet-metal strip 31 has transport slots 32 by means of which it is moved forwards by a transport apparatus, for example by a toothed wheel, driven in the direction of the transport direction of the arrow P.

In step b), a stamping tool 34 is used to stamp out the developed projection of the busbar 4 from the sheet-metal strip 31, while retaining a connection between the narrow face of the busbar 4, which will subsequently point into the housing interior, and a transport area or transport strip 33 which is left at the right-hand edge of the sheet-metal strip 31. In this case, the same reference symbols as those used in FIGS. 1 and 2 denote the same parts or same part sections as the respective screw connecting terminals 1 and 30 described there.

In step c), the contact plate 22 is bent through 90° upwards, that is to say out of the plane of the drawing, which can be done by means of a bending tool integrated in the automatic manufacturing machine. Because the coupling to the transport strip 33 still exists, the guidance and alignment of the developed projection of the busbar 4 towards the bending tool can in this case be carried out very easily and precisely. Further bending operations in order, for example, to produce the vertical limb and the horizontal end piece for a busbar as shown in FIG. 2, can be carried out while the busbar is still connected to the transport strip 33.

The clamping part 3 is now pushed over the free end of the busbar 4 at a feed station c). In this case as well, the positioning of the feed is once again made easier and simplified because the busbar 4 is guided in a defined position, because of the connection to the transport strip 33.

In order to prevent the free ends 26, 27 of the contact plate 22 from becoming stuck, the clamping part 3 is first of all rotated through 90°, so that the insertion opening 12 in it can be pushed over the contact plate 22 on the open longitudinal face 11, whose height H is in fact greater than the length l of the contact plate 22. Once the clamping part 3 has then been pushed onto the busbar 4, it is thus rotated back through 90° again so that it is then in the position as shown at the position c) in FIG. 5 on the busbar 4, which is still connected to the transport strip 33. In this case, the guide tongues 25 engage in the cut-out 16 between the two webs 14, 15 of the clamping part 3, and hold the clamping part 3 on the busbar 4.

In the final step e), the completely assembled screw connecting terminals are now separated by cutting the connection to the transport strip 33.

Reference will now be made to FIGS. 4 and 5, which show a view into an open half-shell 50 of a service switching device, from different viewing angles. The service switching device 50 has a facing front face 51, rear front faces 52, an attachment face 53, front and rear narrow faces 54, 55 which connect the front face to the attachment face, as well as a broad face 61, and is fitted on the attachment face with a fixed tab 56, by means of which the service switching device can be snapped onto a profiled mounting rail. Other structural elements which are provided in the inside of the housing half-shell 50 and are used to hold or fix other assemblies, such as a switching mechanism or arc quenching plates, are irrelevant to the essence of the present disclosure.

A terminal accommodation area 57 is provided close to each of the rear narrow faces 55, and a screw connecting terminal as shown in FIG. 1 or 2 is inserted into it. A screw opening 59 is located in a corresponding position with the clamping screw on the rear front face 52, and an insertion opening 60 for a connecting conductor is located on the rear narrow face 55, in a position corresponding to the insertion opening for the screw connecting terminal.

Plug pockets 62 are fitted close to the rear narrow face 55 on the broad face 61 in the interior of the housing. The guide tongues 25 on the busbar 4, which are formed by the free ends of the contact plate, can be inserted into these plug pockets 62. The depth of the plug pockets can in this case be chosen such that they are at least as large as the length z of the guide tongues 25, which results from the length of that section of the free end 26, 27 of the contact plate 22 which projects beyond the clamping part 3, see FIG. 5, step c).

In this case, the plug pockets 62 may be produced during the injection moulding of the insulating material housing half-shell 50.

Since the busbar 4 for the screw connecting terminal is held in the plug pockets 62, this prevents the screw connecting terminal from sliding into the interior of the appliance when external pressure is exerted on the contact plate. By way of example, this can occur when a test probe makes contact with the contact plate 22 for thermal adjustment of the service switching device, after assembly.

The use of plug pockets to hold the screw connecting terminal as shown in the exemplary embodiments is not exclusive and, in fact, other holding measures with an equivalent effect can also be used, and are also intended to be covered by the present disclosure.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of Reference Symbols

| | | | |
|---|---|---|---|
| 1 | Screw connecting terminal | 30 | Screw connecting terminal |
| 2 | Clamping screw | 31 | Sheet-metal strip |
| 3 | Clamping part | 32 | Transport slot |
| 4 | Busbar | 33 | Transport strip |
| 5 | Slotted conductor strip | 34 | Stamping tool |
| 6 | Free end of the slotted conductor strip | 50 | Housing half-shell |
| 7 | Free end of the slotted conductor strip | 51 | Facing front face |

-continued

| List of Reference Symbols | | | |
|---|---|---|---|
| 8 | Upper broad face of the clamping part | 52 | Rear front face |
| 9 | Opening | 53 | Attachment face |
| 10 | Lower broad face of the clamping part | 54 | Front narrow face |
| 11 | Longitudinal face of the clamping part | 55 | Rear narrow face |
| 12 | Insertion opening | 56 | Fixed tab |
| 13 | Narrow face | 57 | Terminal accommodation area |
| 14 | Web | 58 | Screw connecting terminal |
| 15 | Web | 59 | Screw opening |
| 16 | Cut-out | 60 | Insertion opening |
| 17 | Lateral clasp | 61 | Broad face |
| 18 | Free end | 62 | Plug pocket |
| 19 | Hole | | |
| 20 | Bending edge | | |
| 21 | Free end | | |
| 22 | Contact plate | | |
| 23 | Broad face of the contact plate | | |
| 24 | Bending edge | | |
| 25 | Guide tongue | | |
| 26 | Free end of the contact plate | | |
| 27 | Free end of the contact plate | | |
| 29 | Broad face of the busbar | | |
| 41 | Vertical limb | | |
| 42 | Horizontal end piece | | |

What is claimed is:

1. Service switching device, such as a circuit breaker or residual current device, having an insulating material housing which has at least one front face and one attachment face as well as narrow and broad faces which connect the front and attachment faces, and which service switching device has, in the area of the narrow faces, a terminal accommodation area for a connecting terminal for the connection of an electrical connecting conductor, having a screw connecting terminal which comprises:

a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw, wherein the busbar is fitted at its free end with an approximately rectangular contact plate whose length is greater than the width of the interior of the clamping part which holds the busbar, such that the free ends of the contact plate project beyond the frame-like clamping part on both sides when the busbar is in the installed state, with its length being less than the height of the interior of the clamping part which holds the busbar, wherein holding means for mounting the free ends of the contact plate in a fixed position are provided close to the narrow face of the housing in the interior of the housing.

2. Service switching device according to claim 1, with the busbar being in the form of a stamped and bent part, and with the contact plate being formed by bending an end piece of the busbar after the busbar has been stamped out.

3. Service switching device according to claim 1, with the holding means being in the form of plug pockets which are fitted to the inner housing broad face close to the narrow face of the housing and whose internal dimensions correspond to the external dimensions of the free ends of the contact plate.

4. Service switching device according to claim 1, with the broad face of the contact plate being aligned approximately at right angles to the broad face of the busbar.

5. Service switching device according to claim 1, with the threaded opening which holds the clamping screw being fitted in a broad face of the frame-like clamping part.

6. Service switching device according to claim 5, with the broad face of the contact plate being aligned approximately at right angles to the broad face of the busbar.

7. Service switching device according to claim 4, with the contact plate being integrally connected to the busbar.

8. Service switching device according to claim 7, with the busbar being in the form of a stamped and bent part, and with the contact plate being formed by bending an end piece of the busbar after the busbar has been stamped out.

9. Method for production of a screw connecting terminal which comprises a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw, wherein the busbar is fitted at its free end with an approximately rectangular contact plate whose is greater than the width of the interior of the clamping part which holds the busbar, such that the free ends of the contact plate project beyond the frame-like clamping part on both sides when the busbar is in the installed state, with its length being less than the height of the interior of the clamping part which holds the busbar, the method comprising the following steps:

stamping out the busbars from the stamping area of an elongated sheet-metal strip, while retaining a connection between the busbar narrow faces and the transport area of the sheet-metal strip, bending the free end of the stamped-out busbars in order to form the contact plates, pushing the prefabricated clamping part, which is rotated through 90° with respect to the installed position in the narrow-face plane, over the free end of the busbars, such that the contact plate projects beyond the clamping part, rotation of the clamping part back through 90° such that it comes to rest in its installed position with respect to the busbar, and the free ends of the contact plate, which project beyond the clamping part, prevent the clamping part from sliding off the busbar, and separation of the busbar with the clamping part fitted to it from the transport area of the sheet-metal strip, and thus separation of the completely assembled screw connecting terminals.

10. Method according to claim 9, with the clamping screw being inserted into the clamping part before the latter is pushed onto the busbar.

11. Method according to claim 10, with the clamping screw being tightened until the clamping part is fixed on the busbar, before the screw connecting terminals are separated from the sheet-metal strip.

12. Method for production of a screw connecting terminal which comprises a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, such that a connecting conductor can be clamped firmly between the side of the busbar which faces away from the clamping screw and the broad face of the clamping part which faces away from the clamping screw, wherein the busbar is fitted at its free end with an approximately rectangular contact plate whose length is greater than the width of the interior of the clamping part which holds the busbar, such that the free ends of the contact plate project beyond the frame-like clamping part on both sides when the busbar is in the installed state, with its length being less than the height of the interior of the clamping part which holds the busbar, with the busbar being in the form of a stamped and bent part, and with the contact plate being formed by bending an end piece of the busbar after the busbar has been stamped out, the method comprising the following steps:

stamping out the busbars from the stamping area of an elongated sheet-metal strip, while retaining a connection between the busbar narrow faces and the transport area of the sheet-metal strip, bending the free end of the stamped-out busbars in order to form the contact plates, pushing the prefabricated clamping part, which is rotated through 90° with respect to the installed position in the narrow-face plane, over the free end of the busbars, such that the contact plate projects beyond the clamping part, rotation of the clamping part back through 90° such that it comes to rest in its installed position with respect to the busbar, and the free ends of the contact plate, which project beyond the clamping part, prevent the clamping part from sliding off the busbar, and separation of the busbar with the clamping part fitted to it from the transport area of the sheet-metal strip, and thus separation of the completely assembled screw connecting terminals.

13. Service switching device having an insulating material housing which has at least one front face and one attachment face as well as narrow and broad faces which connect the front and attachment faces, and which service switching device has, in an area of the narrow faces, a terminal accommodation area for a connecting terminal for the connection of an electrical connecting conductor, having a screw connecting terminal, the screw connecting terminal comprising:

a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, wherein holding means for mounting the free ends of a contact plate in a fixed position are provided close to the narrow face of the housing in the interior of the housing.

14. The service switching device according to claim 13, wherein the service switching device is either a circuit breaker or residual current device.

15. A method for production of a screw connecting terminal having a clamping part, which is essentially in the form of a frame and has longitudinal, narrow and broad faces, a clamping screw which is held in a threaded opening in the clamping part, and a busbar which passes through the interior of the frame-like clamping part and is arranged such that it can move with respect to the clamping part, and whose broad face when in the installed state is oriented parallel to the broad face of the clamping part, with the clamping part being movable in its longitudinal direction relative to the busbar by rotation of the clamping screw, the method comprising the following steps:

stamping out the busbars from the stamping area of an elongated sheet-metal strip, while retaining a connection between the busbar narrow faces and a transport area of the sheet-metal strip;

bending a free end of the stamped-out busbars in order to form contact plates;

pushing the clamping part, which is rotated through 90° with respect to an installed position in a narrow-face plane, over the free end of the busbars, such that the contact plate projects beyond the clamping part;

rotation of the clamping part back through 90° such that it comes to rest in its installed position with respect to the busbar, and the free ends of the contact plate, which project beyond the clamping part, prevent the clamping part from sliding off the busbar; and separation of the busbar with the clamping part fitted to it from the transport area of the sheet-metal strip, and thus separation of the completely assembled screw connecting terminals.

* * * * *

UNITED STATES PATENT AND TRADEMARK OFFICE

CERTIFICATE OF CORRECTION

PATENT NO. : 7,575,486 B2
APPLICATION NO. : 12/219581
DATED : August 18, 2009
INVENTOR(S) : Ralf Weber et al.

It is certified that error appears in the above-identified patent and that said Letters Patent is hereby corrected as shown below:

Claim 9, Column 10, Line 38: insert --length-- after the word "whose".

Signed and Sealed this

Third Day of November, 2009

David J. Kappos

David J. Kappos
*Director of the United States Patent and Trademark Office*